US007514622B2

(12) United States Patent
Yoshikawa

(10) Patent No.: US 7,514,622 B2
(45) Date of Patent: Apr. 7, 2009

(54) MUSICAL SOUND PRODUCTION APPARATUS AND MUSICAL

(75) Inventor: Hajime Yoshikawa, Tokyo (JP)

(73) Assignee: Sony Computer Entertainment Inc., Tokyo (JP)

( * ) Notice: Subject to any disclaimer, the term of this patent is extended or adjusted under 35 U.S.C. 154(b) by 765 days.

(21) Appl. No.: 11/153,244

(22) Filed: Jun. 15, 2005

(65) Prior Publication Data

US 2006/0000345 A1 Jan. 5, 2006

Related U.S. Application Data

(63) Continuation of application No. PCT/JP03/13187, filed on Oct. 15, 2003.

(30) Foreign Application Priority Data

Dec. 19, 2002 (JP) ..... 2002-367668

(51) Int. Cl.
*A63H 5/00* (2006.01)
*G04B 13/00* (2006.01)

(52) U.S. Cl. ..... 84/609; 84/611; 84/612; 84/616; 84/477 R

(58) Field of Classification Search ..... None
See application file for complete search history.

(56) References Cited

U.S. PATENT DOCUMENTS 3,991,648 A * 11/1976 Karpowicz ..... 84/470 R
6,121,529 A * 9/2000 Nakata et al. ..... 84/477 R
6,987,220 B2 * 1/2006 Holcombe ..... 84/483.2
7,291,779 B2 * 11/2007 Hasebe ..... 84/477 R
7,320,643 B1 * 1/2008 Brosius et al. ..... 463/37
7,423,214 B2 * 9/2008 Reynolds et al. ..... 84/612
2005/0204901 A1 * 9/2005 Hasebe ..... 84/600
2006/0075887 A1 * 4/2006 Shotwell et al. ..... 84/645
2007/0089590 A1 * 4/2007 Katou ..... 84/609
2007/0227337 A1 * 10/2007 Yoshikawa et al. ..... 84/602

FOREIGN PATENT DOCUMENTS

| | | |
|---|---|---|
| JP | 9-146554 | 6/1997 |
| JP | 2001-243692 | 9/2001 |
| JP | 2001-312857 | 11/2001 |
| JP | 2001-337674 | 12/2001 |
| JP | 2002-352569 | 12/2002 |

OTHER PUBLICATIONS

International Search Report dated Feb. 3, 2004.
Notification of Reason(s) for Refusal, dated Sep. 5, 2008, for corresponding Japanese Application No. 2002-367668.

* cited by examiner

*Primary Examiner*—Marlon T Fletcher
(74) *Attorney, Agent, or Firm*—Katten Muchin Rosenman LLP

(57) ABSTRACT

A control unit controls to access the beat guide file for timings of beats, cues, lyrics, and messages of musical sound data to be reproduced, and controls an image processing unit to display beat guide objects (52*a* and 52*b*), which respectively represent beat timings and reproducing pitches of selected musical sound data. This allows a user to reproduce musical sound data at will by referring to the beat guide objects (52*a* and 52*b*) and visually recognizing beat progression, reproducing pitches, cue positions, lyrics, and messages of the musical sound data to be reproduced.

6 Claims, 11 Drawing Sheets

MUSICAL SOUND PRODUCTION APPARATUS AND MUSICAL

CROSS-REFERENCE TO RELATED APPLICATION

This application is a continuation of International Application PCT/JP03/13187, filed on Oct. 15, 2003, pending at the time of filing of this continuation application and claims priority from Japanese Patent Application Number 2002-367668 filed on Dec. 19, 2002, the contents of which are herein wholly incorporated by reference.

TECHNICAL FIELD

The present invention relates to a musical sound reproduction apparatus and a musical sound reproduction program, which are preferably applied to reproduction of musical sound data through adjustment of reproducing pitches and beat timings of digital musical sound data.

BACKGROUND ART

Conventionally, a musical sound reproduction apparatus that displays waveforms of musical sound data to be reproduced has been known. Such musical sound reproduction apparatus allows a user to reproduce musical sound data of a desired style through adjustment of reproducing pitches and beat timings while referring to the displayed waveforms (for example, Non-Patent References 1 and 2). [Non-Patent Reference 1] The Professional CD Player CDJ-1000, Pioneer Corporation, [searched online Dec. 9, 2003] <URL:http://www.pioneer.co.jp/cdj/cdj1000.html> [Non-Patent Reference 2] Pro-scratch2, American DJ Supply, Inc., [searched online Dec. 9, 2003]<URL:http://www.americandj.com/product.asp?ProductIDNumber=1062&cat=CD_Players>

Nevertheless, since the conventional musical sound reproduction apparatus can basically only display waveforms of musical sound data to be reproduced, a user must perceptively recognize reproducing pitches and beat timings of the musical sound data while referring to the displayed waveforms. Therefore, according to the conventional musical sound reproduction apparatus, a level of proficiency is needed until the user is able to reproduce the musical sound data at will. Furthermore, since cost of the conventional musical sound reproduction apparatus is approximately several hundred thousand yen, which is very pricey, it is difficult for an ordinary person to reproduce musical sound data in the same way as would a disc jockey (DJ).

The present invention has been created for resolving these problems of the conventional technology, and aims to provide a musical sound reproduction apparatus and a musical sound reproduction program, which allow anyone to easily reproduce musical sound data in the same way as does a DJ.

DISCLOSURE OF INVENTION

A musical sound reproduction apparatus and a musical sound reproduction program, which can adjust at least one of a reproducing pitch or beat timings for musical sound data, includes: a display unit that displays various information regarding reproduction of the musical sound data; and a control unit that detects a reproducing pitch and a beat timing for the musical sound data, generates object images that represent the detected reproducing pitch and beat timings, and controls the display unit to display the generated object images.

In other words, with the present invention, reproducing pitch and beat timings for musical sound data to be reproduced are displayed as object images. Furthermore, according the structure of the present invention, since a user can easily and reasonably reproduce musical sound data in the same way as does a DJ by adjusting reproducing pitch and beat timings of musical sound data at will since the user can visually recognize the reproducing pitches and the beat timings of the musical sound data based on the displayed object images.

BEST MODE FOR CARRYING OUT THE INVENTION

Structure of a musical sound reproduction apparatus, according to an embodiment of the present invention, and operations thereof are described in detail forthwith with reference to the accompanying drawings.

[Structure of Musical Sound Reproduction Apparatus]

(Main Unit Structure)

Figure 1:
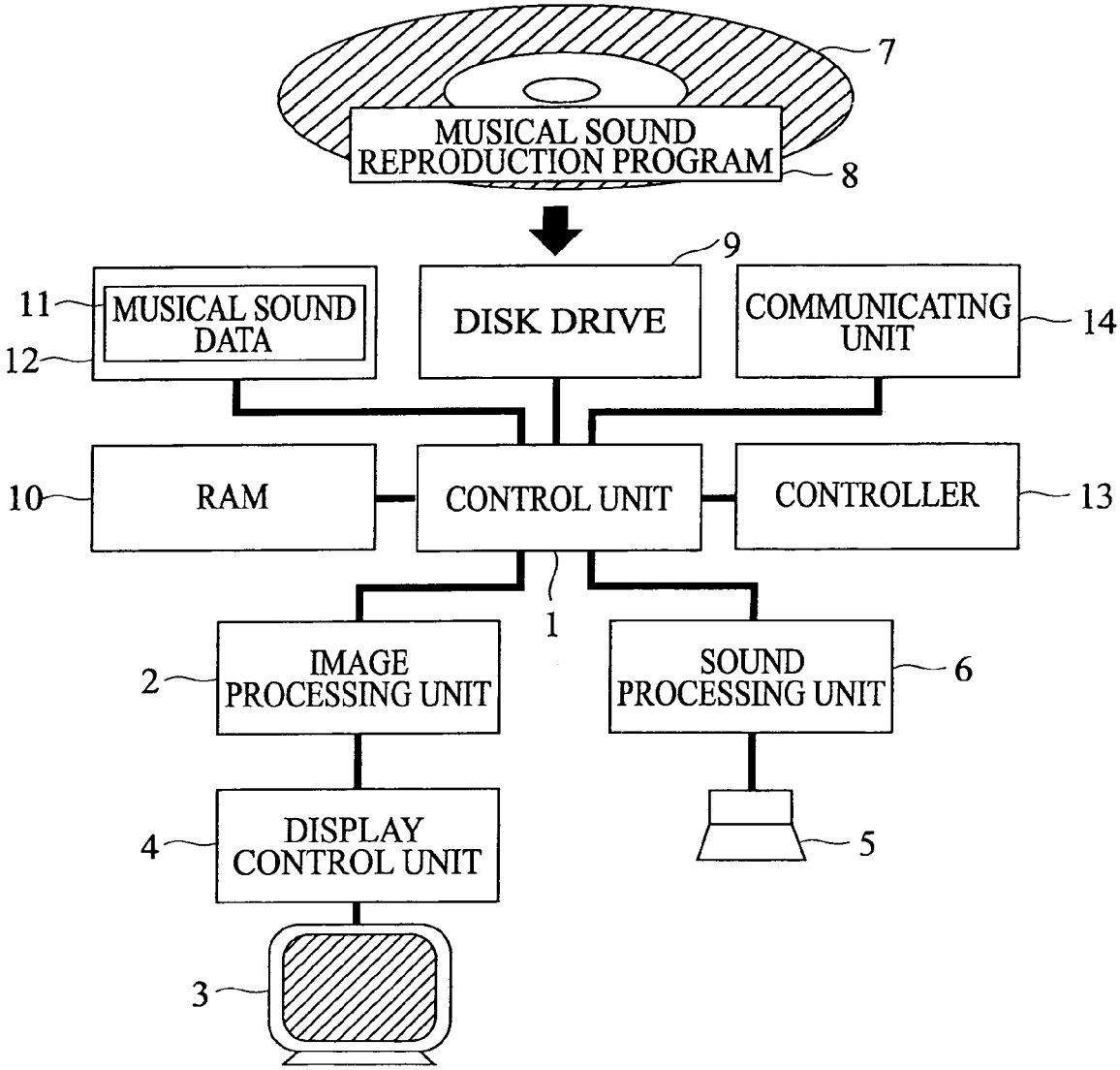
FIG. 1 is a block diagram showing an internal configuration of a musical sound reproduction apparatus, according to an embodiment of the present invention.

A shown in FIG. 1, the musical sound reproduction apparatus, according to the embodiment of the present invention, comprises a control unit 1, which controls signal processing and internal components according to various computer programs; an image processing unit 2, which performs image rendering in conformity with an instruction from the control unit 1 to create various image data associated with musical sound reproduction; a display controller 4, which controls to display upon a display 3 the image data created by the image processing unit 2; and a sound processing unit 6, which outputs sound via a speaker 5 after sound processing is performed in conformity with an instruction from the control unit 1.

This musical sound reproduction apparatus further comprises a disk drive 9, which reads out various computer programs such as a musical sound reproduction program 8 for implementing musical sound reproduction described later and data for processing; random access memory (RAM) 10, which is used as a buffer and is temporarily stored with various computer programs and data read out from an optical disk 7 and which is also used as a working area for the control unit 1; read only memory (ROM) 12, which is stored with various computer programs and data used for processing such as musical sound digital data 11 (hereafter abbreviated as 'musical sound data'); a controller 13, which is manipulated by a user when inputting various instructions regarding musical sound reproduction; and a communicating unit 14, which carries out information communication processing via telecommunications lines such as the Internet or a local area network (LAN).

Note that with this embodiment, the musical sound reproduction program 8 is recorded in the optical disk 7; however, it may be stored in the ROM 12 through processing such as installing or downloading using the communicating unit 14. Furthermore, the musical sound reproduction program 8 may be recorded in a recording medium other than the optical disk 7, such as a floppy™ disk or the like. In this case, replacement of the disk drive 9 with a read out apparatus that can control the recording medium is needed.

Moreover, with this embodiment, musical sound data 11 is stored in the ROM 12. However, it may enter the apparatus through another method such as reading out musical sound data from the optical disk 7 or downloading musical sound data using the communicating unit 14.

(Structure of Musical Sound Reproduction Program)

Figure 2:
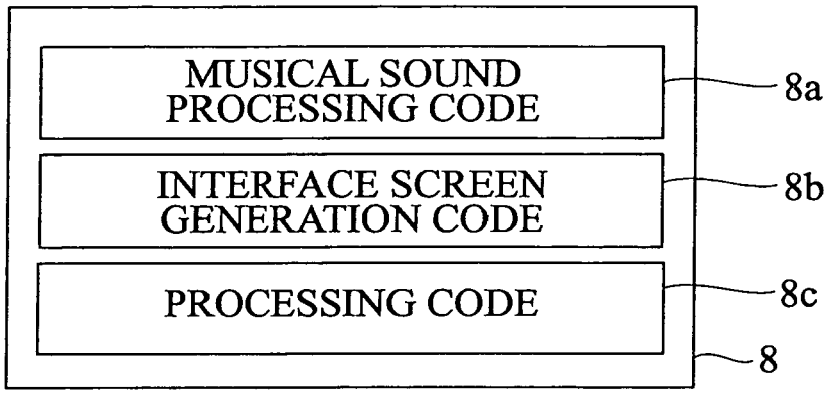
FIG. 2 is a block diagram showing a configuration of a musical sound reproduction program, according to the embodiment of the present invention.

The above-mentioned musical sound reproduction program 8 is constituted of computer program codes, which are for the control unit 1 to execute musical sound reproduction described later, and as shown in FIG. 2, comprises a musical sound reproduction code 8*a*, which is for controlling the sound processing unit 6 to execute musical sound reproduction; an interface screen generation code 8*b*, which is for controlling the image processing unit 2 to generate various image data regarding the musical sound reproduction; and data for various processing 8*c*, which is used for the musical sound reproduction.

(Structure of Musical Sound Data)

Figure 3:
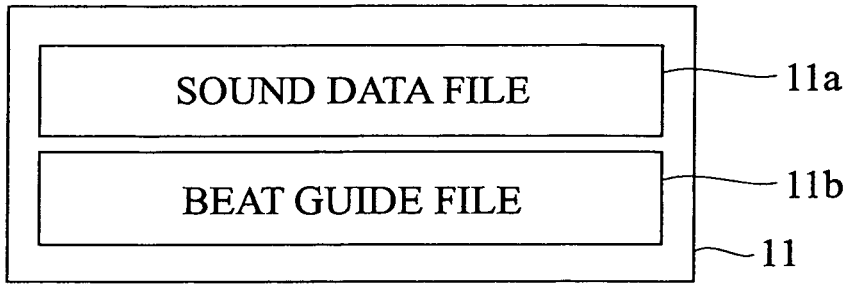
FIG. 3 is a block diagram showing a structure of musical sound data, according to the embodiment of the present invention.
Figure 4:
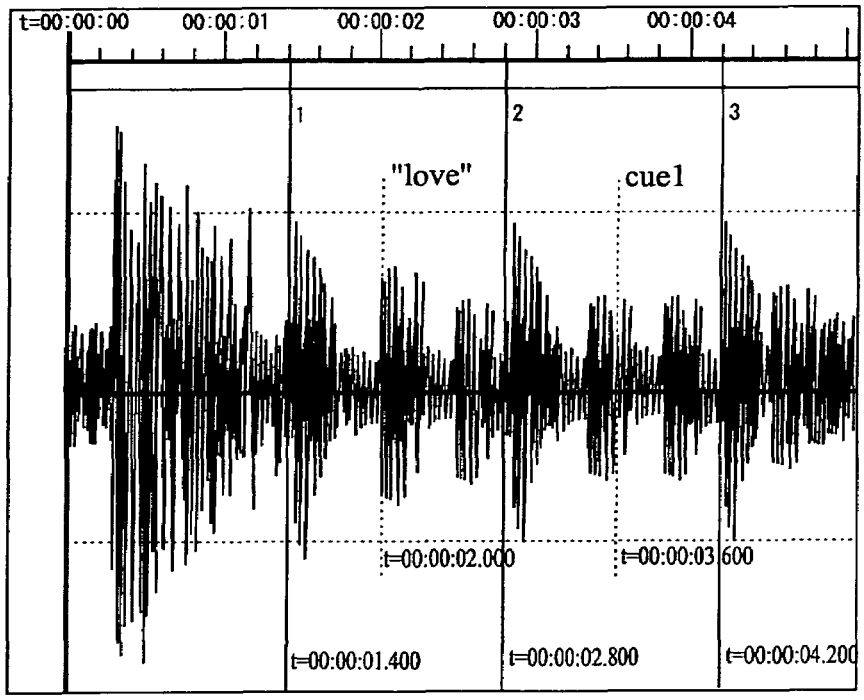
FIG. 4 is a diagram showing the sound data shown in FIG. 3.

As shown in FIG. 3, the above-mentioned musical sound data 11 comprises a sound data file 11*a* and a beat guide file 11*b*, on s musical sound basis, which are associated to each other. The sound data file 11*a* is made up of pulse code modulation (PCM) sound source data, and generates sound that is represented by waveform signals as shown in FIG. 4 and provided by the sound processing unit 6 processing that sound source data.

Figure 5:
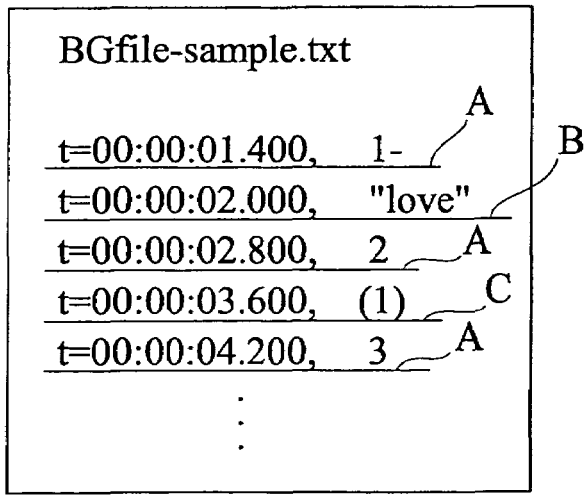
FIG. 5 is a schematic diagram showing a structure of a beat guide file shown in FIG. 3.

The above-mentioned beat guide file 11*b* is structured so as to be reproducible by the user via the controller 13, and timings (reproducing positions) of beats, cues, lyrics, and messages, which reflect the reproduced contents, may be recorded in a file format as shown in FIG. 5. Note that in the beat guide file in the file format shown in FIG. 5, line A indicates timing of a beat ('-' after the number indicates that that timing lands at the top of a bar), and line B indicates timing of a lyric (a letter string within quotation marks represents a lyric.) Furthermore, line C indicates timing of a cue set by the user (the number within brackets indicates a cue number).

(Structure of Controller)

Figure 6:
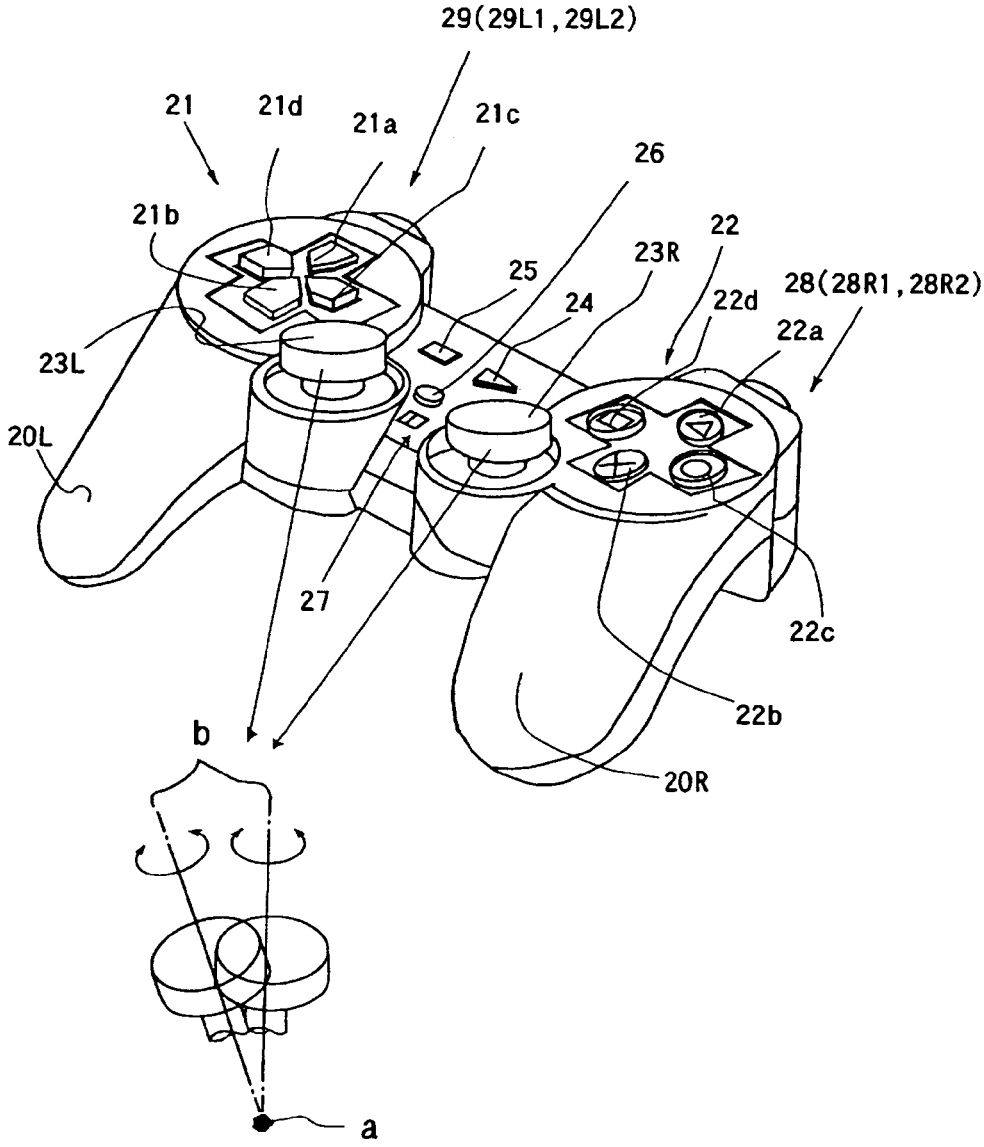
FIG. 6 is a schematic diagram showing a structure of a controller shown in FIG. 1.

As shown in FIG. 6, the above-mentioned controller 13 is structured so that the user can hold it by grip portion 20R and 20L with the right and left hands. Furthermore, this controller 13 is provided with a first and a second operation part 21 and 22 and analog operation parts 23R and 23L at positions respectively operable by, for example, the right and left thumbs with the respective grips 20R and 20L being gripped by the right and left hands.

The above-mentioned first operation part 21 is provided with an up direction key 21*a* and a down direction key 21*b*, which the user uses to command change in various parameters for musical sound data 11 such as reproducing pitch and volume, and a right direction key 21*c* and a left direction key 21*d*, which the user uses to command change in the musical sound data to be reproduced.

The above-mentioned second operation part 22 has a triangle marked button 22*a*, which is for commanding a change in cursor (described later) position to be displayed on the display 3, a cross marked button 22*b*, which is for commanding to start or stop reproduction of musical sound data 11, a circle marked button 22*c*, which is for deciding musical sound data to be reproduced, and a square marked button 22*d*, which is for changing musical sound data to be reproduced.

The above-mentioned analog operation parts 23R and 23L are capable of inclined operation pivoted around a point a, and are further capable of rotational operation around a rotational axis b passing through the pivot a while in an inclined state. These analog operation parts 23R and 23L are held in an upright state (non-inclined state) position (standard position) as shown in FIG. 6 during non-inclined operations. When the analog operation part 23R or the analog operation part 23L is manipulated to incline while being depressed, coordinates (x, y) in an x-y coordinate system are calculated based on the amount and direction of incline relative to the standard position and those calculated coordinates are output to the control unit 1 as operation output. Note that, as will be described in detail later, the user can easily interpret sound in the same way as if rotating a real turntable (namely, pretending to be a DJ) by treating the analog operation parts 23R and 23L as records (turntables).

Furthermore, this controller 13 has a start button 24, which is for commanding the control unit 1 to execute the musical sound reproduction program 8, a select button 25, which is for switching over to a display mode, and a mode select switch 26, which is for selecting analog mode or digital mode. When analog mode is selected by this mode select switch 26, a light-emitting diode (LED) 27 is controlled to emit light, bringing the analog operation parts 23R and 23L into an operating state. On the other hand, when the digital mode is selected, the light-emitting diode 27 is controlled not to emit light, bringing the analog operation parts 23R and 23L into a non-operating state.

Furthermore, this controller 13 is provided with a right button 28 and a left button 29 in positions respectively operable, for example, by the right and left index fingers (or middle fingers) with the grips 20R and 20L being gripped with the right and left hands. These buttons 28 and 29 have a first and a second right button 28R1 and 28R2 and a first and a second left button 29L1 and 29L2, respectively, which are provided in parallel along the thickness of the controller 13, for operating a cross-fader (mixer) object displayed on the display 3 during musical sound reproduction.

In this manner, the musical sound reproduction apparatus, according to the embodiment of the present invention, is structured such that the control unit 1 executes musical sound reproduction for musical sound data 11 specified by the user in conformity with the input provided through the user's manipulation of the controller 13, in conformity with the musical sound reproduction program 8. This musical sound reproduction processing will be described in detail forthwith with reference to FIGS. 7 through 12.

[Musical Sound Reproduction]

(Display of Interface Screen)

The above-mentioned control unit 1 controls the disk drive 9 to read out the musical sound reproduction program 8 from the optical disk 7 and then store it in the RAM 10 in response to the user having placed in the disk drive 9 the optical disk 7, which is recorded with the musical sound reproduction program 8. In response to the user having depressed the start button 24 in the controller 13 to command execution of the musical sound reproduction program 8, the control unit 1 starts controlling the image processing unit 2 to display an interface screen shown in FIG. 7 on the display 3 in conformity with the interface screen generation code 8*b*. When the interface screen is displayed on the display 3, the user manipulates the controller 13 to perform the following musical sound selecting and parameter changing while referring to information displayed in this interface screen, thereby performing a reproduction operation of desired musical sound data 11.

Figure 7:
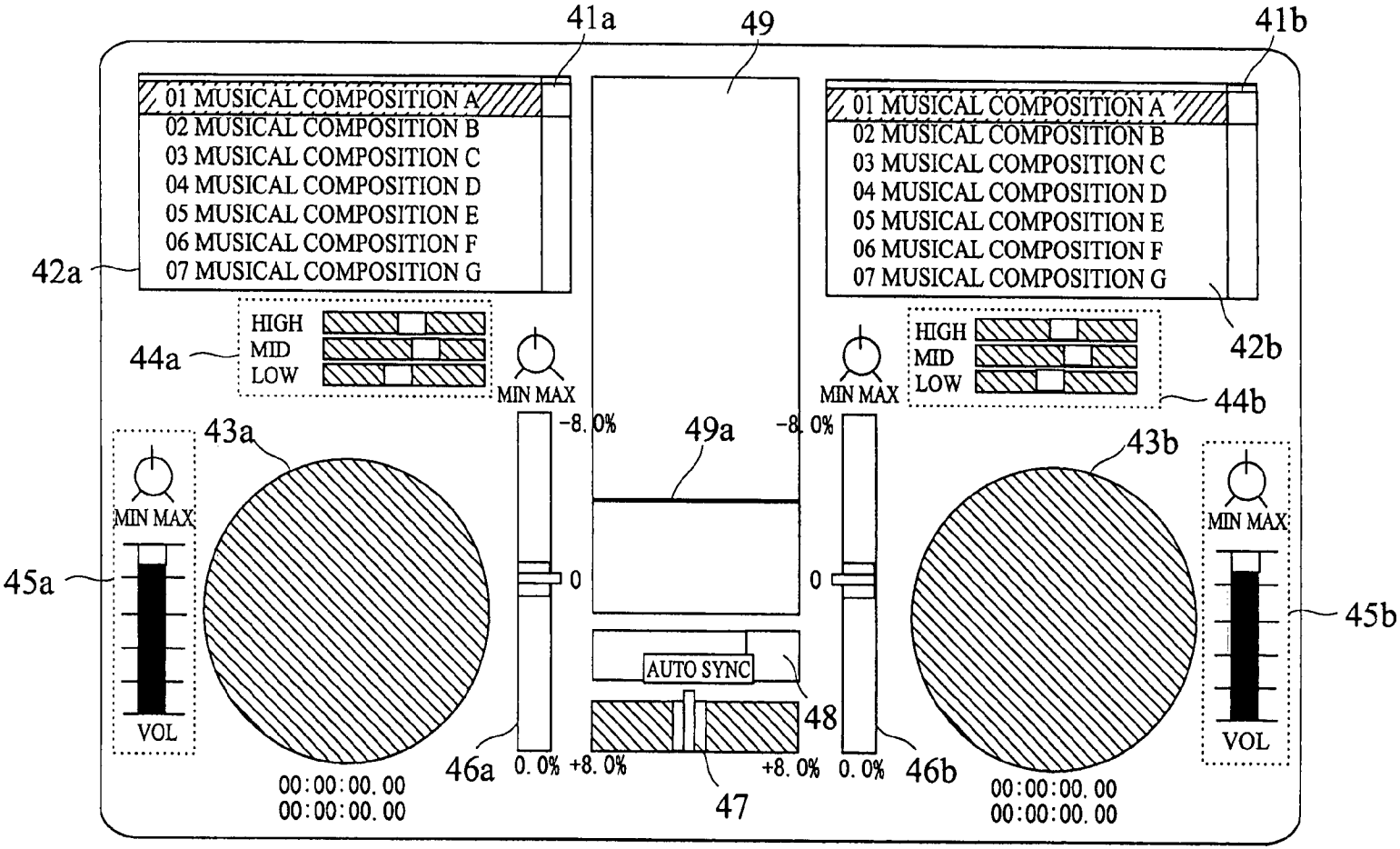
FIG. 7 is a schematic diagram showing a configuration of an interface screen, according to the embodiment of the present invention.

Note that with this embodiment, this interface screen is structured so that the user can simultaneously reproduce two pieces of musical sound data 11. As shown in FIG. 7, reproducible musical sound names are displayed, and musical sound select windows 42*a* and 42*b*, which have cursors 41*a* and 41*b* for selecting musical sound data to be reproduced, and turntable objects 43*a* and 43*b* on which record objects 50*a* and 50*b* (see FIGS. 8 and 9) representing the selected musical sound data 11 are to be arranged, respectively, are also displayed.

The interface screen shown in FIG. 7 further comprises as main components, equalizer objects 44*a* and 44*b* for adjusting frequencies of selected musical sound data 11, volume adjusting objects 45*a* and 45*b* for adjusting reproduction volume of the selected musical sound data 11, pitch adjusting objects (pitch sliders) 46*a* and 46*b* for adjusting the reproducing pitch of the musical sound data 11, a cross-fader object 47 for adjusting a mixing ratio for two pieces of musical sound data 11, a synchronizing operation object 48 for adjusting beat timings of the musical sound data 11, and a beat guide window 49, which has a reproduction line 49*a* indicating the reproducing position of the musical sound data 11 and displays beat progressions for respective musical sound data 11.

Further with this embodiment, although file names for musical sound data 11, which are pre-stored in the ROM 12, are displayed as reproducible musical sound names in the musical sound select windows 42*a* and 42*b*, the user may manipulate the controller 13 to specify a region that allows referring to the file name for the musical sound data 11, and then accordingly display the file name for musical sound data 11 stored in the region other than the ROM 12.

(Selection of Musical Sound Data)

When the interface screen is displayed on the display 3 in the above manner, the user can select a name for musical sound data 11 to be reproduced, from the musical sound select windows 42*a* and 42*b* by manipulating the controller 13 to move the cursors 41*a* and 41*b*.

Figure 8:
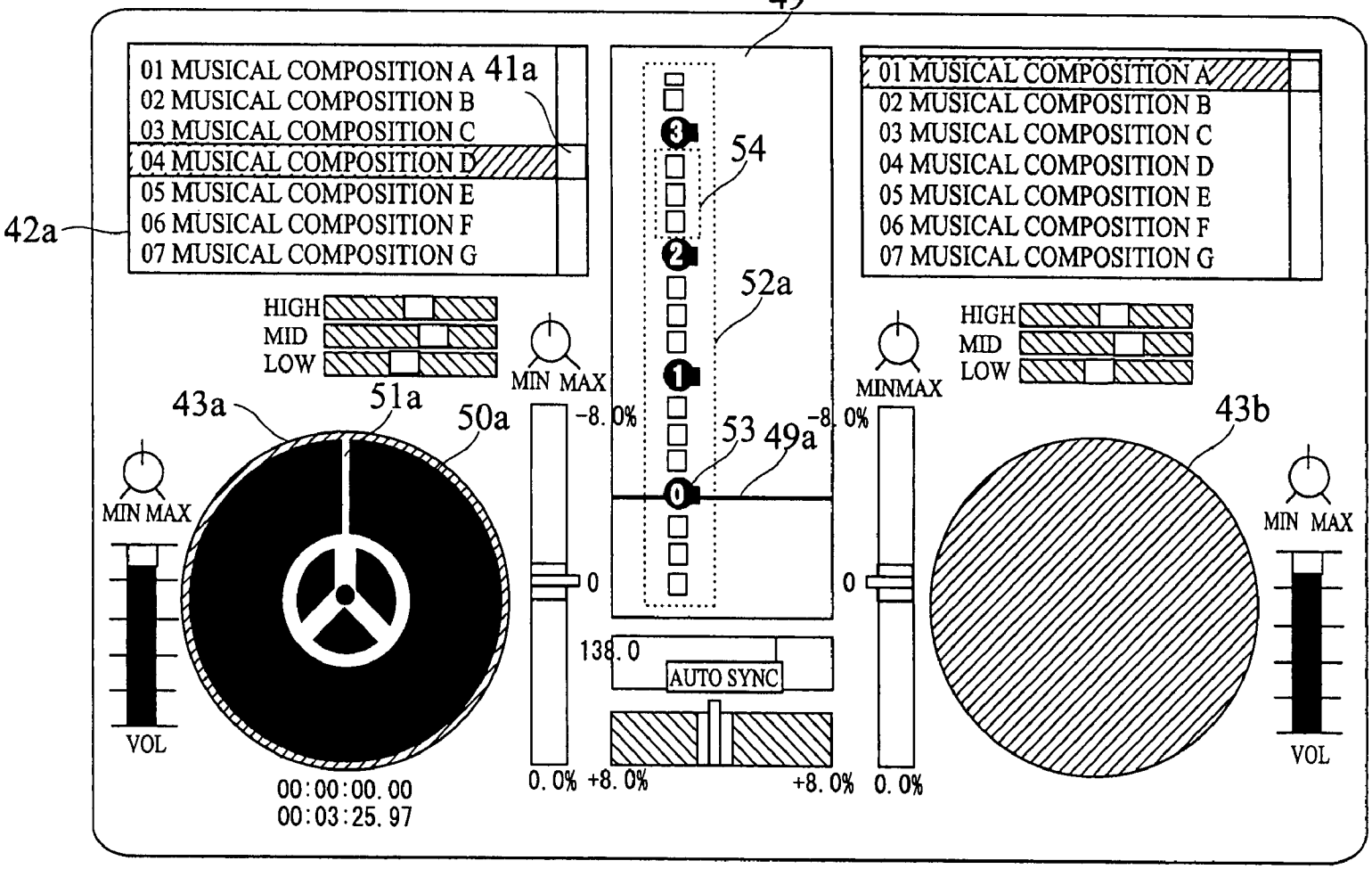
FIG. 8 is a schematic diagram showing a configuration of the interface screen when one piece of musical sound data is selected.
Figure 9:
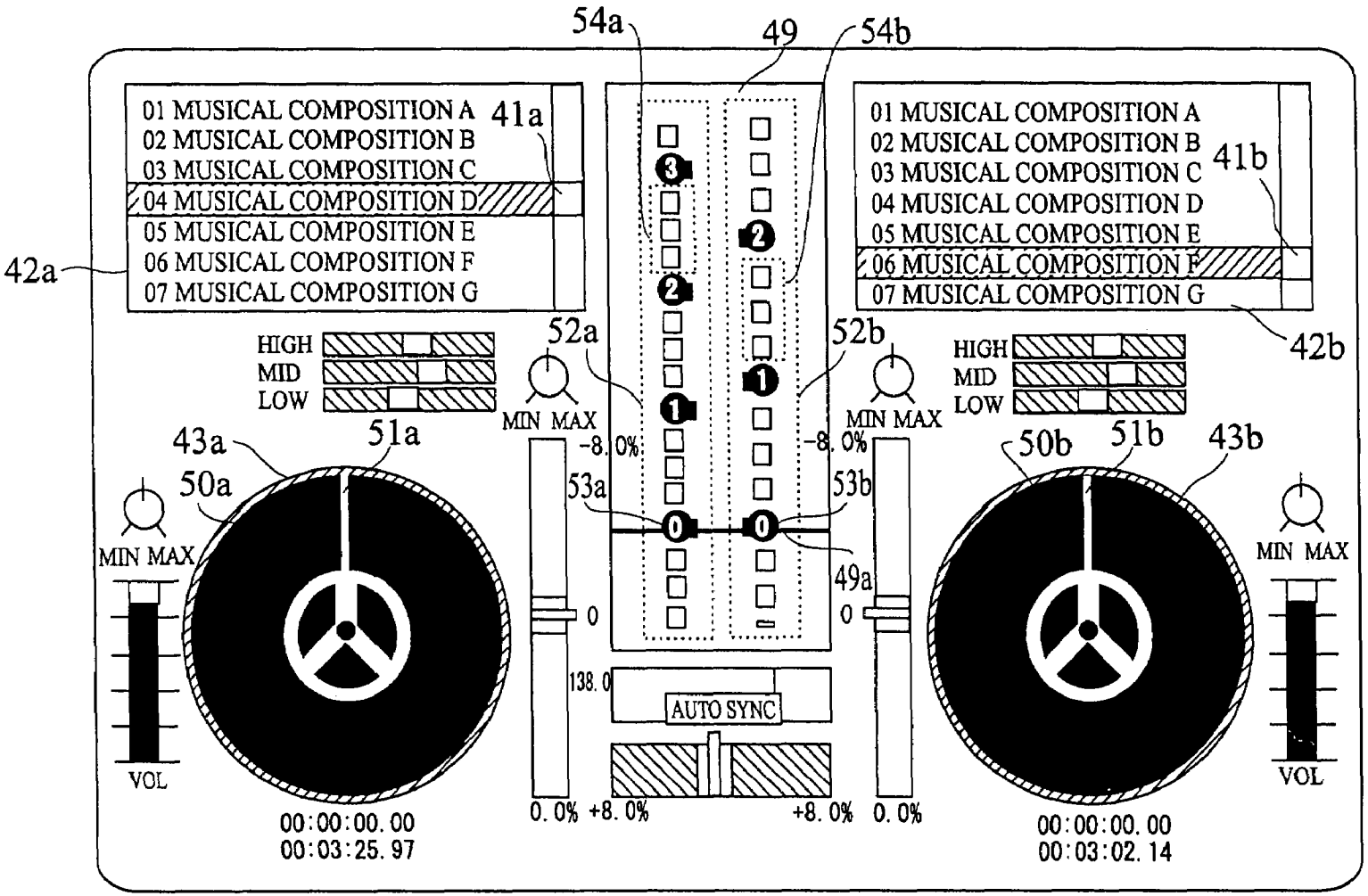
FIG. 9 is a schematic diagram showing a configuration of the interface screen when two pieces of musical sound data are selected.

In response to the user having decided musical sound data 11 to be reproduced by depressing the circle button 22*c* of the controller 13, the control unit 1 then controls the image processing unit 2 to display on the turntable objects 43*a* and 43*b* the record objects 50*a* and 50*b*, which represent the musical sound data 11 selected by the user, respectively, in conformity with the interface screen generation code 8*b*, as shown in FIG. 8 (in a state where musical sound D is selected from the musical sound select window 42*a*) and FIG. 9 (in a state where musical sounds D and F are selected from the musical sound select windows 42*a* and 42*b*, respectively). Note that reproduction lines 51*a* and 51*b* indicating reproducing positions of the musical sound data 11 are displayed in these record objects 50*a* and 50*b*, respectively, so that the user can visually recognize the reproducing positions of the musical sound data 11, and as described later, these reproduction lines 51*a* and 51*b* are shifted and displayed according to the reproducing positions of the musical sound data 11.

Furthermore, at this time, as shown in FIGS. 8 and 9, the control unit 1 controls the image processing unit 2 to display in the beat guide window 49 beat guide objects 52*a* and 52*b*, which represent beat timings and reproducing pitches of the selected musical sound data 11, while referring to the beat guide file 1*b* for the selected musical sound data 11, according to the interface screen generation code 8*b*. More specifically, the control unit 1 refers the beat guide file 11*b*, extracts beat timings (reproducing positions) of musical sound data to be reproduced, and then calculates time intervals between beat sounds, which will be used as reproducing pitches, in accordance with the extracted timings. As shown in FIGS. 8 and 9, the control unit 1 then controls to display the beat guide objects 52 (52*a* and 52*b*) constituted by multiple beat timing display objects 53 (53*a* and 53*b*), which are deployed at beat positions and are each assigned a corresponding beat number (numbers in line A shown in FIG. 5), and pitch display objects 54 (54*a* and 54*b*), which are deployed between these beat timing display objects 53. Note that in the case where data of lyrics, cues (lines B and C shown in FIG. 5) and the like is stored in the beat guide file 11*b*, the control unit 1 visually displays that information at positions in the beat guide objects 52 corresponding to the reproduction timing of the stored information.

When selection of musical sound data 11 is completed in the above manner, the user may depress the square button 22*d* of the controller 13 to command reproduction start of the selected musical sound data 11. In conformity with the command for reproduction start of the musical sound data 11, the control unit 1 controls the sound processing unit 6 to output sound for the selected musical sound data 11 via the speaker 5, according to a musical sound processing code 8*a*.

Figure 10:
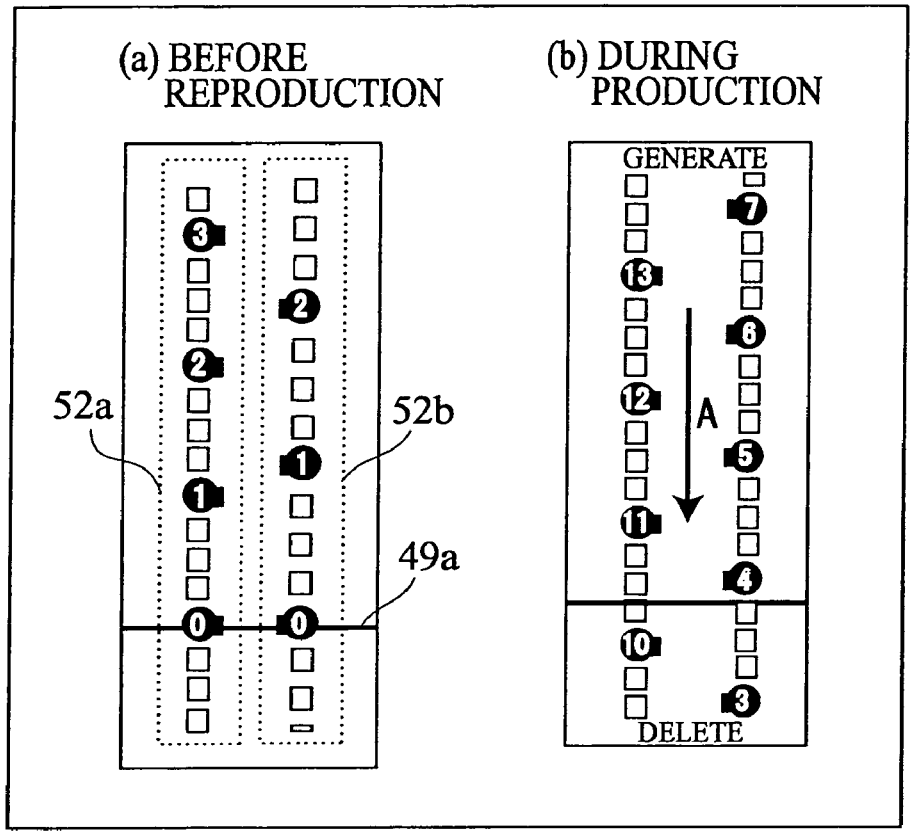
FIG. 10 is a schematic diagram showing a configuration of the interface screen during reproduction of musical sound data.

Furthermore, as shown in FIGS. 10(*a*) and (*b*), according to the interface screen generation code 8*b*, the control unit 1 moves and displays the beat guide objects 52*a* and 52*b* regarding two pieces of musical sound data 11 at a constant speed A in synch with the reproduction speed along the length of the reproduction line 49*a* while repeatedly updating, generating and destroying display contents, such as a beat number, in accordance with the reproducing positions of the musical sound data 11. The control unit 1 also moves and displays the reproduction lines 51*a* and 51*b* on the record objects 50*a* and 50*b*, respectively, so that the user can visually recognize the reproducing positions during the entire reproduction time of the musical sound data 11.

As such, according to the musical sound reproduction apparatus of the embodiment of the present invention, in response to the user having selected musical sound data to be reproduced, the control unit 1 controls the image processing unit 2 to display the record objects 50*a* and 50*b* corresponding to the selected musical sound data 11 on the turntable objects 43*a* and 43*b*, allowing the user to reproduce the musical sound data 11 as if operating a real turntable and enjoy pretending to be a DJ.

Furthermore, according to the musical sound reproduction apparatus of the embodiment of the present invention, the control unit 1 refers the beat guide file 1*b* for timings of beats, cues, lyrics, and messages in the musical sound data to be reproduced, and then controls the image processing unit 2 to display the beat guide objects 52*a* and 52*b*, which respectively represent beat timings and reproducing pitches of the selected musical sound data 11. This allows the user to reproduce musical sound data 11 at will while referring to the beat guide objects 52*a* and 52*b* and visually recognizing beat progression, reproducing pitches, cue positions, lyrics, and messages of the musical sound data to be reproduced 11.

Further according to the musical sound reproduction apparatus of the embodiment of the present invention, the user can visually recognize beat progression, reproducing pitches, cue positions, lyrics, and messages of past, present and future musical sound data 11 while referring to positional relationships between the beat guide objects 52*a* and 52*b* and the reproducing line 49*a* in the beat guide window 49.

Further according to the musical sound reproduction apparatus of the embodiment of the present invention, since the control unit 1 controls the image processing unit 2 to move and display the beat guide objects 52*a* and 52*b* regarding two pieces of musical sound data 11, the user can easily visually recognize synchronism of pitches and beats of the two pieces of musical sound data 11. In addition, the user can visually recognize beat timings of the musical sound data 11 by referring to timings of when the beat timing display objects 53 reach the reproducing line 49*a*.

Moreover, according to the musical sound reproduction apparatus of the embodiment of the present invention, the above-described processing is carried out in conformity with a computer program without use of additional hardware components, allowing development of a low-cost musical sound reproduction apparatus.

(Changing Musical Sound Parameters)

With the musical sound reproduction apparatus of the embodiment of the present invention, when the musical sound data 11 is being reproduced, the user can, for example, change parameters such as reproducing positions, frequencies, volume, and reproducing pitches of the musical sound data 11, utilize cues, and/or mix two pieces of musical sound data 11 by manipulating each object in the interface screen while referring to the beat guide objects 52*a* and 52*b*, and then reproduce the musical sound data 11. Operations in the musical sound reproduction apparatus when the user is changing reproducing positions of musical sound data (changing reproducing position), changing reproducing pitches of the musical sound data 11 (changing pitch), and mixing two selected pieces of musical sound data 11 (mixing) through manipulation of the controller 13 are described in detail forthwith.

(Changing Reproducing Position)

With the above-mentioned musical sound reproduction apparatus, a user can change reproducing positions of musical sound data 11 by performing rotational operation of the analog operation parts 23R and 23L. An operation of the musical sound reproduction apparatus when the user changes a reproducing position will be described referring to a flowchart shown in FIG. 11.

Figure 11:
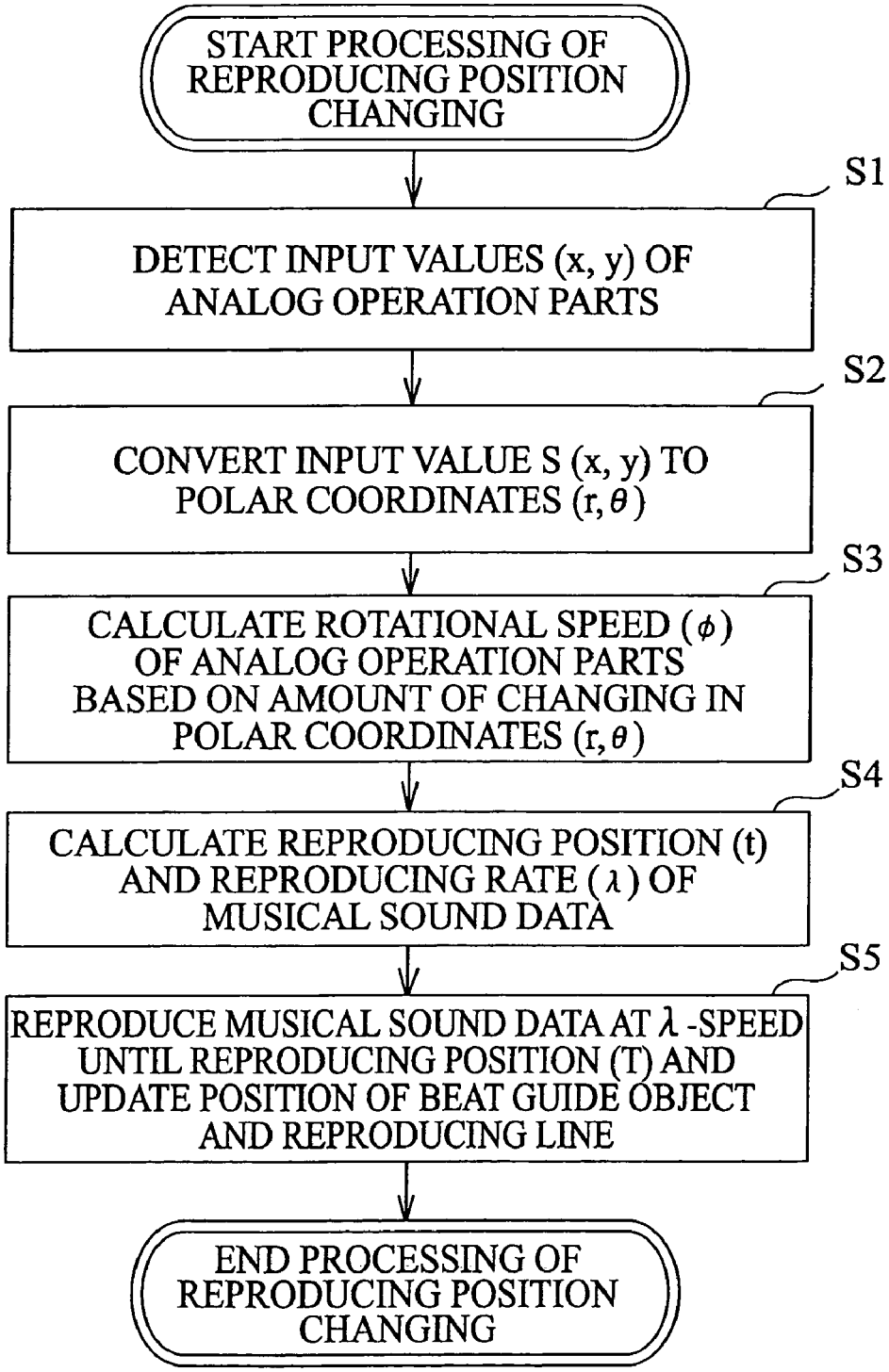
FIG. 11 is a flowchart showing a flow of changing reproducing position, according to the embodiment of the present invention.
Figure 12:
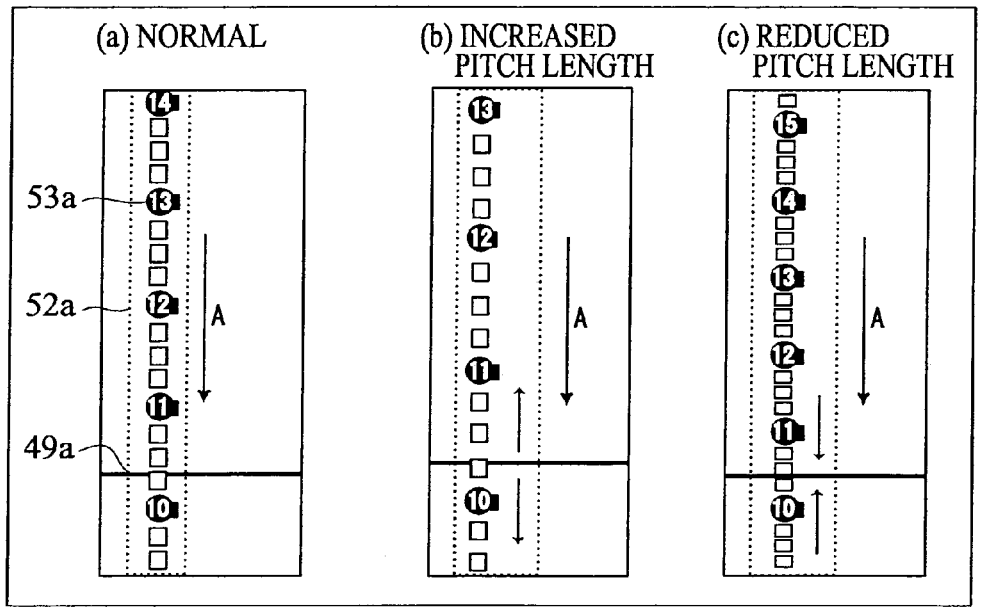
FIG. 12 is a schematic diagram describing a pitch changing process, according to the embodiment of the present invention.

The flowchart shown in FIG. 11 starts with the user rotating the record objects 50*a* and 50*b* by performing rotational operation of the analog operation parts 23R and 23L. The control unit 1 then carries out processing of the following steps S1 through S5 in conformity with the musical sound reproduction program 8.

In the processing of step S1, the control unit 1 detects input values (x, y) provided from the analog operation parts 23R and 23L in the controller 13. Processing of this step S1 is accordingly completed, and this processing of reproducing position changing proceeds from step S1 to step S2.

In the processing of step S2, the control unit 1 converts the detected input values (x, y) to polar coordinates (r, θ). Processing of this step S2 is accordingly completed, and this processing of reproducing position changing proceeds from step S2 to step S3.

In the processing of step S3, the control unit 1 calculates rotational speed (ϕ) of the analog operation parts 23R and 23L based on an amount of change in the polar coordinates (r, θ). Processing of this step S3 is accordingly completed, and this processing of reproducing position changing proceeds from step S3 to step S4.

In the processing of step S4, the control unit 1 calculates a reproducing positions (t) and a reproducing rate (λ) for the musical sound data 11 in accordance with the calculated rotational speed (ϕ) of the analog operation parts 23R and 23L. Processing of this step S4 is accordingly completed, and this processing of reproducing position changing proceeds from step S4 to step S5.

In the processing of step S5, the control unit 1 controls the sound processing unit 6 to change reproducing pitch in synch with the reproductive rate (λ), reproduce (λ-speed reproduction) the musical sound data 11, and output sound for the selected musical sound data 11 at the reproducing positions (t) in conformity with the musical sound processing code 8*a*. Furthermore, the control unit 1 moves and displays reproducing positions (t) of the reproducing lines 51*a* and 51*b* simultaneous to moving and displaying the beat guide objects 52*a* and 52*b* in conformity with the interface screen generation code 8*b* so that the beat guide objects are displayed at the reproducing positions (t). The processing of this step S5 is accordingly completed, terminating the reproducing position changing sequence.

As such, according to the musical sound reproduction apparatus of the embodiment of the present invention, the user can easily change a reproducing position (t) of musical sound data 11 in the same way as if rotating a real turntable by rotating and treating the analog operation parts 23R and 23L as records.

Furthermore, according to the musical sound reproduction apparatus of the embodiment of the present invention, since the control unit 1 moves and displays the beat guide objects 52 and the reproducing lines 51*a* and 51*b* in sync with the reproducing positions (t) in response to changes in the reproducing positions (t), the user can easily determine which position in the musical sound data 11 the present reproducing position (t) is at, and in the case where the beat guide objects 52*a* and 52*b* for two pieces of musical sound data 11 are displayed, can easily carry out processing such as synchronizing the musical sound data 11 through comparison of the beat guide objects 52*a* and 52*b* for the musical sound data 11.

(Changing Pitch)

According to the above-mentioned musical sound reproduction apparatus, the user manipulating the controller 13 to move a pitch adjusting object (pitch slider) 46*a*, thereby changing reproducing pitches of the musical sound data 11 allows changing intervals between the beat timing display objects 53*a*. Therefore, the user can visually recognize the amount of change in reproducing pitch.

More specifically, with this embodiment, when the user manipulates the controller to move the pitch adjusting object 46*a*, thereby commanding amplification of the reproducing pitch, the control unit 1 moves beat timing display objects 53*a* from positions shown in FIG. 12*a* to positions shown in FIG. 12*b* relative to the reproducing line 49*a* as if the beat guide object 52*a*, which is moving at a constant speed A, were stretched with the reproducing line 49*a* as the center.

On the other hand, when the user manipulates the controller to move the pitch adjusting object 46*a*, thereby commanding reduction of the reproducing pitch, the control unit 1 moves beat timing display objects 53*a* from positions shown in FIG. 12*a* to positions shown in FIG. 12*c* relative to the reproducing line 49*a* as if the beat guide object 52*a*, which is moving at a constant speed, were shrunken with the reproducing line 49*a* as the center.

In this manner, with the musical sound reproduction apparatus of the embodiment of the present invention, since the control unit 1 controls the image processing unit 2 to change the intervals between beat timing display objects 53 in response to the changes in reproducing pitch, the user can visually recognize the reproducing pitches of the musical sound data 11 by referring to the change in intervals between beat timing display objects 53.

(Mixing)

Figure 13:
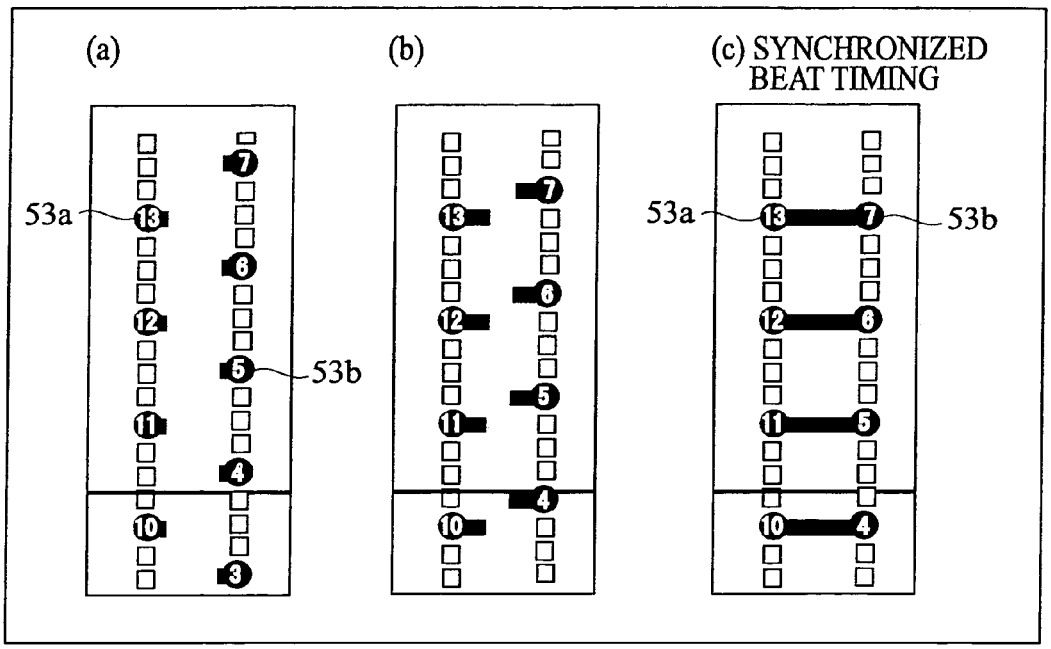
FIG. 13 is a schematic diagram describing a mixing process, according to the embodiment of the present invention.

The above-mentioned musical sound reproduction apparatus assists the user in a mixing operation by changing the shape of beat timing display objects 53 shown in FIG. 13, allowing the user to change reproducing pitches and/or beat timings of the musical sound data 11, thereby mixing two pieces of musical sound data 11. In other words, the control unit 1 observes beat timings of the two pieces of musical sound data 11 in conformity with the musical sound reproduction program 8, and as shown in FIG. 13, controls the image processing unit 2 to change the shape of each of the beat timing display objects 53*a* and 53*b* in accordance with synchronism of the beat timings of the two pieces of musical sound data 11, allowing the user to mix two pieces of musical sound data 11. When the beat timings of the two pieces of musical sound data 11 are perfectly synchronous, the control unit 1 controls the image processing unit 2 to combine and display corresponding beat timing display objects 53*a* and 53*b* of the two pieces of musical sound data 11 as one, as shown in FIG. 13(*c*).

In this manner, with the musical sound reproduction apparatus of the embodiment of the present invention, since the control unit 1 controls the image processing unit 2 to change the shape of the beat timing display objects 53 according to synchronism of the beat timings of the two pieces of musical sound data 11, the user can easily recognize synchronism of the two pieces of musical sound data 11 by referring to the shape of the beat timing display objects 53.

Other Embodiments

While the embodiments according to the present invention developed by the inventor(s) are described above, it should not be understood that the description and drawings that constitute part of this disclosure are to limit the present invention. For example, the interface screen of the above embodiment has a structure allowing selection and reproduction of two pieces of musical sound data 11. However, the present invention is not limited to this, and it may be structured to allow selection and reproduction of three or more pieces of musical sound data 11. In this manner, alternative embodiments, working examples, and operational techniques provided based on this embodiment according to the present invention by those skilled in the art are naturally included within the scope of the present invention.

INDUSTRIAL APPLICABILITY

The musical sound reproduction apparatus according to the present invention can be applied to reproducing of musical sound data in a desired style through, for example, adjusting reproducing pitches and beat timings of musical sounds.

The invention claimed is:

1. A musical sound reproduction apparatus, which is capable of adjusting at least one of a reproducing pitch or beat timings for musical sound data, comprising:

a display unit that displays various information regarding reproduction processing of the musical sound data; and a control unit that detects a reproducing pitch and a beat timing for the musical sound data, generates object images that represent the detected reproducing pitch and beat timings, controls the display unit to display the generated object images for each musical sound data when there are two or more pieces of musical sound data to be reproduced, and moves and displays object images for each piece of musical sound data at the same speed.

2. The musical sound reproduction apparatus according to claim 1, wherein the object images are first object images deployed at beat positions.

3. The musical sound reproduction apparatus according to claim 1, wherein the control unit combines and displays first object images for musical sound data in sync with beat timings.

4. A computer readable musical sound reproduction program product for adjusting at least one of a reproducing pitch or a beat timing for musical sound data, the computer readable musical sound reproduction program causing a computer to:

display various information regarding reproduction processing of the musical sound data;

detect a reproducing pitch and a beat timing for the musical sound data;

generate object images that represent the detected reproducing pitch and beat timing; and control a display unit to display the generated object images for each musical sound data when there are two or more pieces of musical sound data to be reproduced, and to move and display object images for each piece of musical sound data at the same speed.

5. The computer readable musical sound reproduction program product, according to claim 4, wherein the object images are first object images deployed at beat positions.

6. The computer readable musical sound reproduction program product, according to claim 4, further causing the computer to combine and display first object images for musical sound data in sync with beat timings.

* * * * *